United States Patent [19]

Yaeger

[11] 4,005,867

[45] Feb. 1, 1977

[54] CARD GAME

[76] Inventor: Michael Joseph Yaeger, Apartado 97, Altea, Alicante, Spain

[22] Filed: June 12, 1975

[21] Appl. No.: 586,187

[52] U.S. Cl. ..... 273/135 R; 273/152 R

[51] Int. Cl.[2] ..... A63F 3/00; A63F 1/00

[58] Field of Search ..... 273/130 R, 130 H, 134 C, 273/135 R, 135 AC, 137 R, 152 R, 152.3, 152.7 R, 135 C, 136 R, 152.4; 35/31 D, 31 F, 31 G, 70

[56] References Cited

UNITED STATES PATENTS

| | | | |
|---|---|---|---|
| 367,223 | 7/1887 | Moody | 35/31 G |
| 1,115,441 | 10/1914 | Lake | 273/137 C |
| 1,532,722 | 4/1925 | Wall | 273/135 R |
| 1,652,979 | 12/1927 | Francke | 273/152 R |
| 2,712,446 | 7/1955 | McKeever | 273/135 AC |
| 3,001,301 | 9/1961 | Carl | 35/70 |
| 3,649,023 | 3/1972 | Schohn | 273/135 AC |
| 3,708,169 | 1/1973 | Hoy | 273/152.4 |
| 3,758,962 | 9/1973 | Bagdasar | 35/31 G |

*Primary Examiner*—Anton O. Oechsle
*Assistant Examiner*—Harry G. Strappello
*Attorney, Agent, or Firm*—Burgess Ryan and Wayne

[57] ABSTRACT

There is disclosed a new game and a combination for playing the game, comprising a board and a pack of cards, the pack of cards including cards which carry a numeral thereon and are not marked to indicate a value, other cards having a "minus" point scoring value indicated thereon, other cards having a "plus" point scoring value indicated thereon, and still other cards having a numeral thereon, and also having a point scoring value indicated thereon, the board being divided into numbered spaces into which the cards may be played, there being one space for each different numeral on the cards of the pack.

3 Claims, 3 Drawing Figures

CARD GAME

The present invention relates to a card game, and an object of the invention is to provide a card game which is both novel and interesting.

According to the present invention there is provided in combination, a board and a pack of cards, the pack of cards including cards which carry a numeral thereon and not being marked to indicate a value, other cards having a "minus" point scoring value indicated thereon, other cards having a "plus" point scoring value indicated thereon, and still other cards having a numeral thereon, and also having a point scoring value indicated thereon, the board being divided into numbered spaces into which the cards may be played, there being one space for each different numeral on the cards of the pack.

In order that the present invention may be more readily understood, a sample game according to the invention and one set of rules for playing such game will now be described by way of example, with reference to the accompanying drawing, Wherein.

THE EQUIPMENT

Figure 1:
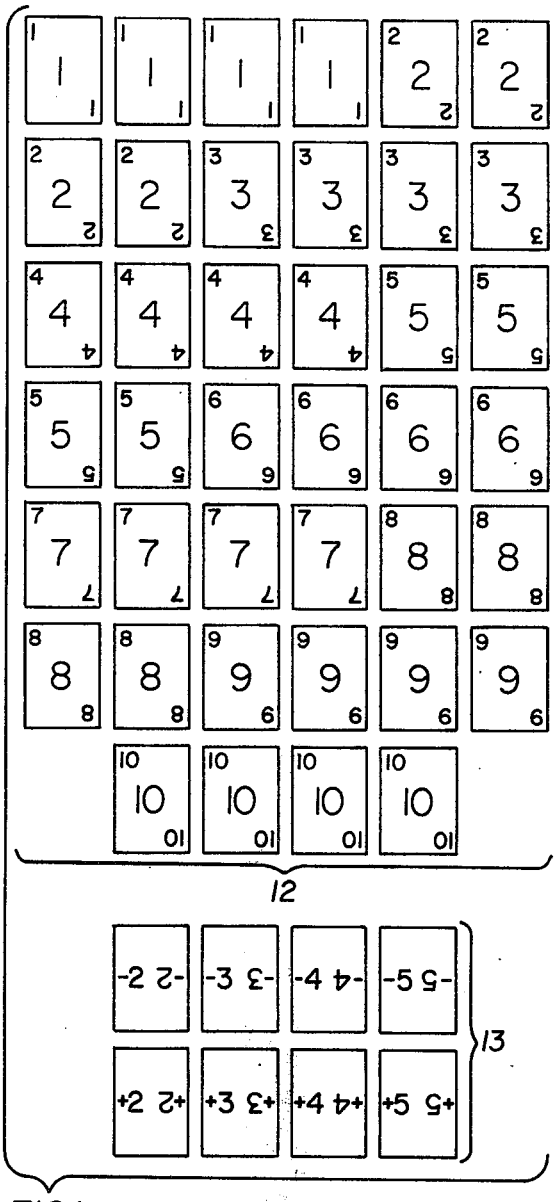
FIG. 1 is an illustration of one embodiment of a set of cards for use in the invention.
Figure 2:
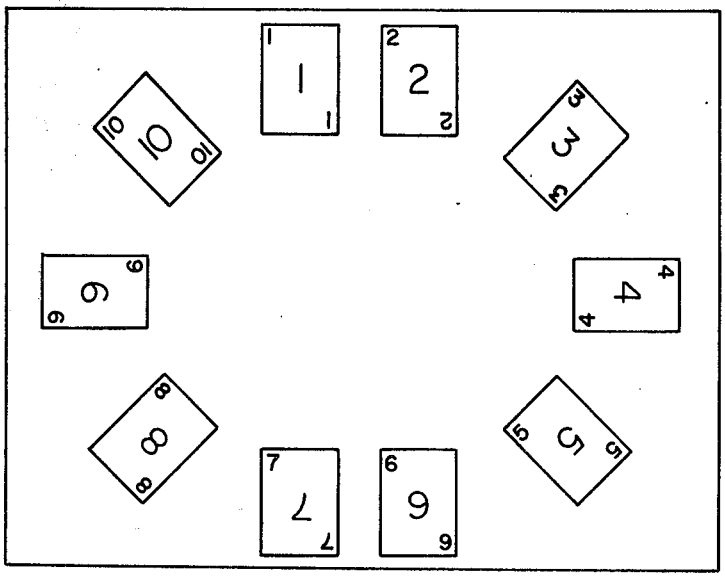
FIG. 2 is a simplified illustration of a playing board, for use with the set of cards of FIG. 1.

FIG. 1 illustrates a set of 48 playing cards, in accordance with one embodiment of the invention, and FIG. 2 illustrates a playing board 10 having 10 spaces 11 marked thereon for the placement of the playing cards of FIG. 1. The spaces 11 on the board 10 are marked with the numerals "1" to "10".

Forty of the cards illustrated in FIG. 1, i.e., the cards 12, each carry a numeral thereon, each of the numerals "1" to "10" appearing on four of the cards. The other eight cards, i.e., the cards 13, bear respectively, the following information: "minus 5" "minus 4", "minus 3", "minus 2", "plus 2", "plus 3", "plus 4", and "plus 5". The above-mentioned 40 cards carrying numerals will be referred to as "numeral" cards, whereas the other eight cards will be referred to as "non-numeral" cards.

Figure 3:
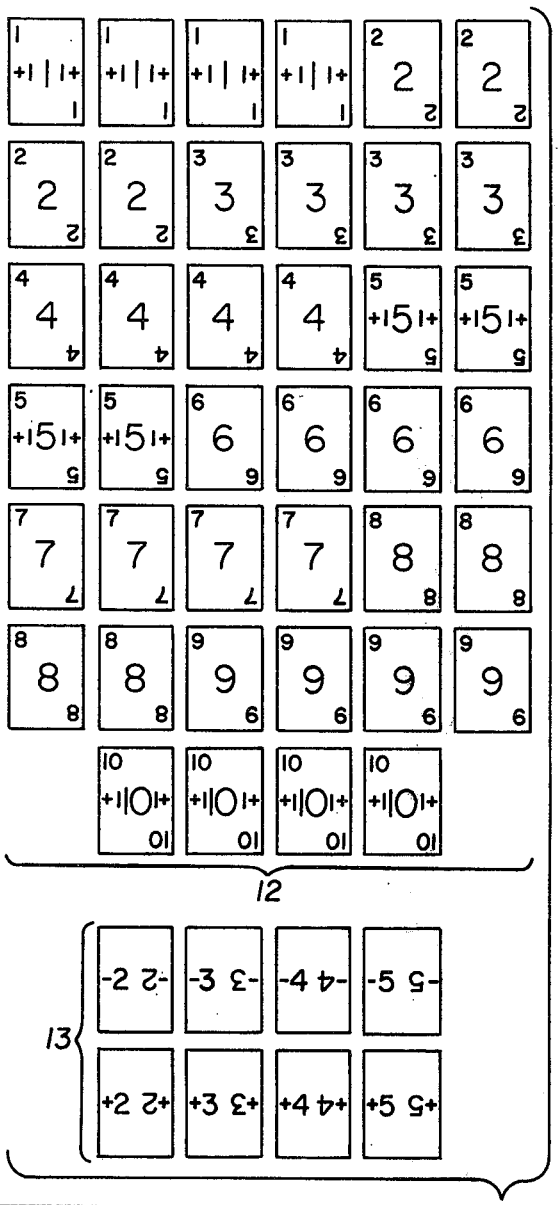
FIG. 3 is an illustration of a modification of the set of cards of FIG. 1.

Twenty of the cards of the pack have a point scoring value as will be explained hereinafter. Eight of the 20 cards comprise the non-numeral cards, and the other 12 of the numeral cards bear the numerals "1", "5" and "10". These point scoring cards may be distinguished from the other cards of the pack in any suitable manner, for example being printed in a different color, or by being so marked with a value "plus 1", as illustrated in FIG. 3.

During the play of the game according to one possible set of rules to be described below, the 12 numeral cards which are also point scoring cards will have a numerical scoring value of one, and therefore the cards are suitably marked to indicate this. The eight non-numeral cards all of which are point scoring cards have the point scoring value marked thereon as described above, for example "plus 2" or "minus 3".

OBJECT OF THE GAME

The object of the game is to score points, the points being scored mainly by amassing any of the 16 plus value point scoring cards, and it will be appreciated that any minus value point scoring cards acquired by a player will detract from that players score. The winner may be declared the player having the most points after the play of an agreed number of hands, or alternatively it may be the player who is first to score an agreed number of points.

THE DEAL

The following description applies to the game when played by two players, although it will be appreciated that the rules will vary if more players are to play. The two players each cut the pack and the player who turns up the card being the highest numeral is the player who deals first. Naturally, if a non-numeral card is cut or in the event of a tie the cards must be cut again. The dealer deals, one at a time four cards to his opponent and to himself. The remainder of the pack is placed to the dealer's side. There will be five more deals, each of four cards each, with the deal passing alternately between the players.

THE PLAY

The play passes alternately from player to player, and on each turn a player must play a card from his hands. To facilitate the following description, examples of actual play will be given, and for this reason reference will be made hereinafter to player "A" and player "B".

Cards must be player upon the board provided, and cards are always played face downwards. To commence play after a deal, a player, for example player "B", produces a card from his hand and places it face downwardly on any numbered space on the board. The card played need not necessarily bear the same numeral as the numeral appearing on the playing space into which the card is played, although a player will always either verbally or by implication aver that it does. Whenever a player plays a card and states the numeral allegedly appearing thereon, or alternatively implies that the card carries a certain numeral by the manner in which the card is played, the other player may challenge the player of the card to show the card face upwardly in order that the numeral may be seen. The challenge may take the form of a cry of "BULL" from the challenging player. This will be dealt with in detail under the heading "The Challenge".

As stated above, in order to score points one must acquire cards, in particular point scoring cards, and the way in which cards may be acquired will become apparent from the following description of various playing maneuvers available to the players. Pairing: Supposing that player "B" declares a card in his hand to be a "6", and places such card face down on the board in the space marked "6". Then, player "A" may take the "6" with a card from his hand which he declares to be a "6". In order to do this, he places his card face down on top of "B's" "6" and gathers both cards in, placing them face down in front of him to form a pile of cards which will be used when scores are calculated at the end of play. It will be understood that the original card allegedly a "6" played by "B" and the subsequent card also allegedly a "6" played by "A" need not in fact be "6's" but could be any other card, numeral or non-numeral. Either player could be challenged at the time of playing either card, as described below under the heading "The Challenge", and it will be appreciated that in the following examples of play any card player can equally well be challenged. Combining: In order to acquire cards by combining, a player takes two or more cards which have a combined playing value equal to the cards which he wishes to acquire. If there are cards on the board in playing spaces "3", "6", "2" and "7" then a player may declare a card from his hand to be a "9". He combines his alleged "9"to with the alleged "3" and "6", and also with the alleged "2" and "7" and collects all five cards which are placed on his pile of cards as decribed above. Building: A player can build from his hand onto a card already on the board, and the two cards are then moved together to a space on the playing board bearing the numeral which is the sum of the numerals allegedly appearing on the two cards. On a player's subsequent turn, the player then may acquire both of the cards with a card from his own hand. For example, if a card is in playing space "3" and player "A" decides to build up this "3" to a "9", then "A" takes a card from his hand and places it on top of the "3", shifting both cards to the playing space "9". In doing this, the player declares "this is a six, and I am building up to a nine". In his next turn player "A" may gather his built "9" with a card from his hand which he declares to be a "9". Building can be continued by both players to make a combination of three, four or more cards. For example, if there is a card on the space on the board marked "1" and "B" declares a card from his hand to be a "2", he may then move both cards to the "3" space of the board and declare "building a three", player "A" on his following turn may then place a card (by implication a "2") on top of the "3" and shift the cards to playing space "5" declaring "building to five". Player "B" may then on his next following turn place still another card (by implication a "4") on top of the existing cards, and may move such cards to the "9" space on the board, declaring "building to nine". Of course at every play of a card a player has the option to challenge the card played. It will be understood that every time a card is added to a card or cards in play on the board, the stack formed is then shifted to the appropriately numbered play space on the board.

Players may also build down instead of up. For example, player "A" may place a card from his hand on a card in playing space "3", shifting the two cards to playing space "7" and declaring "building 7's". Player "B" may then with a card he claims to be a "5", place his card on top of the built "7" and shift the three cards down to playing space "2", declaring my "5" from your "7" is "2". Of course now player "A" may challenge "B's" card, or if he has or wants to declare a card a "2", may take the alleged "2". Also he now can build the "2" up or down by the above-described maneuver. This building process can include any number of cards, but the maneuver must be completed before four new cards are dealt. The rules which apply to the building up process apply equally to the building down process.

Matching: As an example of matching, player "A" may take a card already on the "4" space on the board together with a "5" card from his hand, and also together with a "9" card from his hand, and may place all three cards on the "9" playing space with the intention of collecting all three cards with a "9" from his hand on his subsequent turn. of course, player "A" may be challenged at any time, or player "B" may take the cards with an alleged "9" card from his own hand.

General: A card built or matched cannot subsequently be claimed separately, since a built or matched card has become part of a combination and can only be collected as a whole. However, if as a result of a challenge as described below a built or matched card is exposed to be false, all cards involved are returned to their correspondingly numbered playing spaces. A player who has made either a combining, building or matching maneuver is obliged to take the cards involved in his next turn unless he can utilize the next card from his hand in a play other than simply placing it on the board.

If, at a player's turn, he is not able or does not wish to participate in a pairing, combining, building, or matching maneuver, then the player must play a card from his hand face down on an appropriate playing space on the board.

When the four cards first dealt to each player are all played, then four more cards are dealt by another dealer as described above and the game goes on unitl all cards of the pack are played. Any cards left on the board when all cards have been played from the hand remain on the board and are not included in any player's scoring.

A player is obliged to take a combination of any cards on the board equal to the playing value of the card he wishes to put down. For example, if a player plays a card from his hand that he declares to be a "9" and places it on the "9" playing space, and if there are other cards on the board such as the "2", "3", "4", or "4" and "5", or any combination totalling "9", then a player cannot place the "9" on the board but must collect this combination with his "9". This rule is subject to player observation. If the player of the "9" suspects that there may be a minus value non-numeral card in a combination which he should collect, then he may attempt to avoid picking up the cards by non-observance of the above rule. The stack of cards collected by each player cannot be shuffled at any time.

THE CHALLENGE

A challenge is made when a player does not believe that a card's declared playing value is the same as the actual playing value noted on its face. A player must take his challenge before he takes his own turn. If a card is not challenged at this time, its declared playing value stands, and the card cannot be subjected to another challenge.

Awards are given to whichever player proves correct as a result of a challenge. For example, should player "A" challenge player "B" when "B" plays a card face down upon the "6" playing space, "B" acknowledges the challenge by turning the played card face up. In this case, if the card played is proven to be a "6", then "A" must pay "B" one card from his stack of cards. If the card is proven not to be a "6", then "B" must pay "A" one card from his stack. Any player who has not collected any cards in his stack is under no obligation to pay his penalty. As stated above, when a card which is merely being placed on a vacant space on the board is challenged the award to be payed by the appropriate player is one card only. However, when a card is challenged in the act of collecting two or more cards from the board, then all the cards in that play are given to the winner plus the award of an equal number of cards taken from the loser's stack of collected cards. For example, player "A" may declare a card from his hand to be a "6", and proceeds to collect three cards placed in playing spaces "1", "2" "3". He is challenged by "B" and turns his card face up. If the card thus exposed is proved to be a "6", then "B" must pay to "A" four cards from his stack of collected cards. Hence, player "A" will collect the four cards in play plus an equal number of cards from "B". If a non-numeral card is exposed as a result of a challenge, the non-numeral card, whether it be plus or minus, immediately goes to the appropriate player together with an award of one card from the loser's stack of collected cards. If a numeral card is exposed to be false as a result of a challenge when such card is merely being placed in a vacant square on the playing board, then the award of one card is paid but the false card on the board is merely shifted to its correct playing space.

As another example of a challenge, let us suppose that "A" has built one or more cards up to a "5", and that "B", then plays an alleged "4" on the "5" declaring that he is building up to "9". If "B" is challenged by "A" and the exposed card should prove not to be a "4", then the exposed card is returned to the playing space equal to its playing value whereas the previously built "5" stands as a whole and may be collected on the next turn.

SCORING

At the end of play, for example when the pack of cards is exhausted, the player having the most cards in his pile is awarded three scoring points. The scoring cards are then removed from a player's pile and totalled, each numeral card scoring one point, and each non-numeral card scoring between plus five and minus five according to the value appearing thereon.

As stated above, the winner may be declared to be the player having the most points when a pack of cards is exhausted, or alternatively a winner may be declared when a previously arranged number of points is scored by either player.

The cards of the pack may if desired, be printed in three colors. For example, the point scoring cards having a "plus" value may be printed in green, the point scoring cards having a "minus" value being printed in red, and the non-point scoring cards being printed in amber.

The board may be arranged in any suitable way provided that it has ten spaces to receive the numeral cards.

If the spaces are to be arranged in a circle, then those cards which have a point scoring value of plus one may be "1", "4", and "8" cards instead of the "1", "5", and "10" cards in order to achieve a symmetrical arrangement around the board.

What I claim is:

1. In combination, a playing board and a pack of cards, the pack of cards including a set of frist cards, each carrying a different numeral thereon, a set of second cards having a "minus" point scoring value indicated thereon, a set of third cards having a "plus" point scoring value indicated thereon, the board being divided into differently numbered spaces into which the cards may be played, there being one space for each different numeral on the cards of the pack, said first set of cards carrying no point scoring value thereon, and a fourth set of cards in said pack of cards, each having at least two numerals thereon, one of said numerals on the cards of said fourth set indicating a point scoring value.

2. In combination, a playing board and a pack of cards, the pack of cards including 48 cards; there being 28 first cards having a numeral thereon and having no point scoring value thereon, one of 7 determined numerals appearing on each of the cards of the first set, each of said 7 determined numerals appearing on 4 of the cards of the first set; 4 second cards, each having a different numeral thereon and having a "minus" point scoring value indicated thereon; a set of 4 third cards each having a different numeral thereon having a "plus" point scoring value indicated thereon; a set of 12 fourth cards, each having thereon one of three determined numerals different from any of said 7 determined numerals, each of said 3 determined numerals appearing on 4 separate fourth cards, said set of fourth cards having both a numeral thereon and a numerical point scoring value indicated thereon.

3. A combination according to claim 2, wherein the said seven determined numerals and the said three determined numerals together comprise the numerals one to ten.

* * * * *